US007360862B2

(12) United States Patent
Jantzi et al.

(10) Patent No.: US 7,360,862 B2
(45) Date of Patent: Apr. 22, 2008

(54) INKJET APPARATUS AND A METHOD OF CONTROLLING AN INKJET MECHANISM

(75) Inventors: Philip J. Jantzi, Waterloo (CA); David A. Murison, Kitchener (CA)

(73) Assignee: NCR Corporation, Dayton, OH (US)

( * ) Notice: Subject to any disclaimer, the term of this patent is extended or adjusted under 35 U.S.C. 154(b) by 248 days.

(21) Appl. No.: 11/079,847

(22) Filed: Mar. 14, 2005

(65) Prior Publication Data

US 2006/0203033 A1 Sep. 14, 2006

(51) Int. Cl.
*B41J 2/165* (2006.01)

(52) U.S. Cl. ..... 347/29; 347/23; 347/30; 347/32

(58) Field of Classification Search ..... 347/23, 347/29, 32, 37, 30; 318/600, 696, 685
See application file for complete search history.

(56) References Cited

U.S. PATENT DOCUMENTS 4,734,718 A * 3/1988 Iwagami et al. ..... 347/28
5,075,609 A 12/1991 Ito et al.
5,416,395 A * 5/1995 Hiramatsu et al. ..... 318/600
5,757,395 A * 5/1998 Chew et al. ..... 347/24
2004/0108828 A1 6/2004 Jung
2004/0141782 A1 7/2004 Kato

* cited by examiner

*Primary Examiner*—Shih-Wen Hsieh
(74) *Attorney, Agent, or Firm*—Michael Chan

(57) ABSTRACT

A method of controlling an inkjet mechanism having an inkjet head movable between a capped position and a print position comprises the steps of receiving a first switch signal indicative of the inkjet head moving into the vicinity of one of the positions of the inkjet head as the inkjet head is moving towards the one of the positions of the inkjet head, and moving the inkjet head a learned amount towards the one of the positions of the inkjet head after the first switch signal has been received. The method may further comprise the steps of receiving a second switch signal indicative of the inkjet head moving into the vicinity of the other one of the positions of the inkjet head as the inkjet head is moving towards the other one of the positions of the inkjet head, and moving the inkjet head another learned amount towards the other one of the positions of the inkjet head after the second switch signal has been received. The learned amounts may be substantially the same.

8 Claims, 9 Drawing Sheets

INKJET APPARATUS AND A METHOD OF CONTROLLING AN INKJET MECHANISM

BACKGROUND OF THE INVENTION

The present invention relates to inkjet printing, and is particular directed to an inkjet apparatus and a method of controlling an inkjet mechanism.

During typical inkjet printing operation, an inkjet head is moved between a capped position and a print position. Alternatively, the inkjet head may be held stationary and an opposing mechanism is moved between a first position such that the inkjet head is in the capped position and a second position such that the inkjet head is in the print position. In either case, an encoder arrangement may be employed to provide positional information about the inkjet head so that a controller can process this information to control inkjet printing operation. Known encoder arrangements typically include an encoder which counts and keeps track of pulse signals to establish position of the inkjet head relative to a home position of the inkjet head. A drawback in using known encoder arrangements to provide positional information about an inkjet head is that encoders are relatively costly devices.

Alternatively, a switch arrangement may be employed to provide positional information about an inkjet head. Known switch arrangements typically include a first switch which is activated when the inkjet head is in the capped position and a second switch which is activated when the inkjet head is in the print position. A drawback in using known switch arrangements to provide positional information about an inkjet head is that the switches need to have relatively tight switching point tolerances or need to be manually adjusted after assembly. Switches which have tight switching point tolerances are relatively costly devices, and manual adjusting of switches after assembly requires time-intensive labor. Although known switch arrangements usually cost less and require less manual adjusting than known encoder arrangements, it would be desirable to provide a low cost switch arrangement in which relatively inexpensive switches can be used and any manual adjusting of switches after assembly is either eliminated or at least reduced.

SUMMARY OF THE INVENTION

In accordance with one aspect of the present invention, a method of controlling an inkjet mechanism having an inkjet head movable between a capped position and a print position comprises the steps of receiving a first switch signal indicative of the inkjet head moving into the vicinity of one of the positions of the inkjet head as the inkjet head is moving towards the one of the positions of the inkjet head, and moving the inkjet head a learned amount towards the one of the positions of the inkjet head after the first switch signal has been received.

The method may further comprise the steps of receiving a second switch signal indicative of the inkjet head moving into the vicinity of the other one of the positions of the inkjet head as the inkjet head is moving towards the other one of the positions of the inkjet head, and moving the inkjet head another learned amount towards the other one of the positions of the inkjet head after the second switch signal has been received. The learned amounts may be substantially the same.

In accordance with another aspect of the present invention, a method of generating a learned distance for later use in accurately positioning an inkjet head of an inkjet mechanism comprising the steps of moving the inkjet head in a first direction towards an end position of the inkjet head until a first switch signal is provided, continue moving the inkjet head in the first direction until the inkjet head is unable to move further in the first direction, moving the inkjet head in a second direction which is opposite the first direction after the inkjet head is unable to move further in the first direction, continue moving the inkjet head in the second direction until a second switch signal is provided, tracking the distance taken from when the inkjet head is unable to move further in the first direction until the second switch signal is provided, and storing the tracked distance as the learned distance for later use in accurately positioning the inkjet head.

In accordance with another aspect of the present invention, an inkjet apparatus comprises an inkjet head movable between a first position in which the inkjet head is capped and a second position in which the inkjet head is ready to print, an activatable first switch which, when activated, provides a first signal indicative of the inkjet head being in one of the first and second positions. The inkjet apparatus further comprises an actuatable stepper motor for (i) moving the inkjet head toward the first position when the stepper motor is actuated to operate in a first direction, and (ii) moving the inkjet head toward the second position when the stepper motor is actuated to operate in a second direction which is opposite the first direction. The inkjet apparatus also comprises a controller which detects presence of the first signal from the first switch when the stepper motor is actuated to move the inkjet head towards the one of the first and second positions of the inkjet head, and controls the stepper motor such that the inkjet head continues to move a first previously learned distance towards the one of the first and second positions of the inkjet head when the first signal from the first switch is detected.

The inkjet apparatus may further comprise an activatable second switch which, when activated, provides a second signal indicative of the inkjet head being in the other one of the first and second positions. The controller detects presence of the second signal from the second switch when the stepper motor is actuated to move the inkjet head towards the other one of the first and second positions of the inkjet head, and controls the stepper motor such that the inkjet head continues to move a second previously learned distance towards the other one of the first and second positions of the inkjet head when the second signal from the second switch is detected. The second previously learned distance and the first previously learned distance may be substantially the same.

BRIEF DESCRIPTION OF THE DRAWINGS

The foregoing and other features of the present invention will become apparent to one skilled in the art to which the present invention relates upon consideration of the following description of the-invention with reference to the accompanying drawings, wherein.

DETAILS OF THE INVENTION

The present invention relates to inkjet printing, and is particular directed to an inkjet apparatus and a method of controlling an inkjet mechanism.

Figure 1:
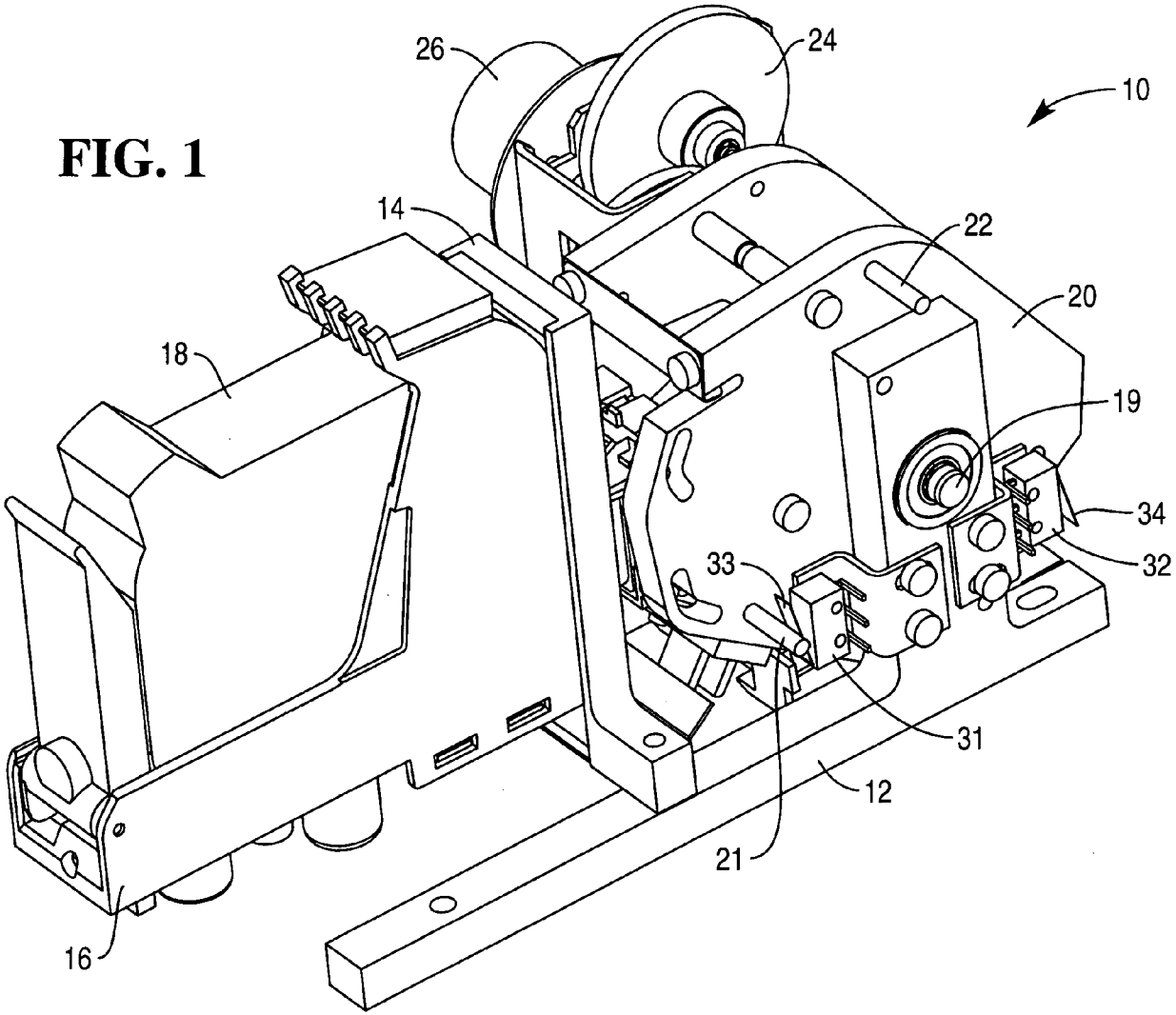
FIG. 1 is a perspective view of a rotary-type of inkjet mechanism embodying the present invention, and showing an inkjet head in a capped position.

Referring to FIG. 1, a rotary-type of inkjet mechanism 10 is illustrated. The mechanism 10 may be used in self-service terminal applications such as automated teller machines. The mechanism 10 includes a first frame part 12 to which a second frame part 14 is securely attached. A cartridge holding bracket 16 is attached to the second frame part 14 in known manner. An inkjet cartridge 18 having a number of inkjet heads is releasably held in the bracket 16. A capping assembly 20 is rotatably mounted on a shaft 19. The shaft 19 is drivingly connected through a number of reduction gears 24 to an output shaft of an actuatable stepper motor 26.

Figure 2:
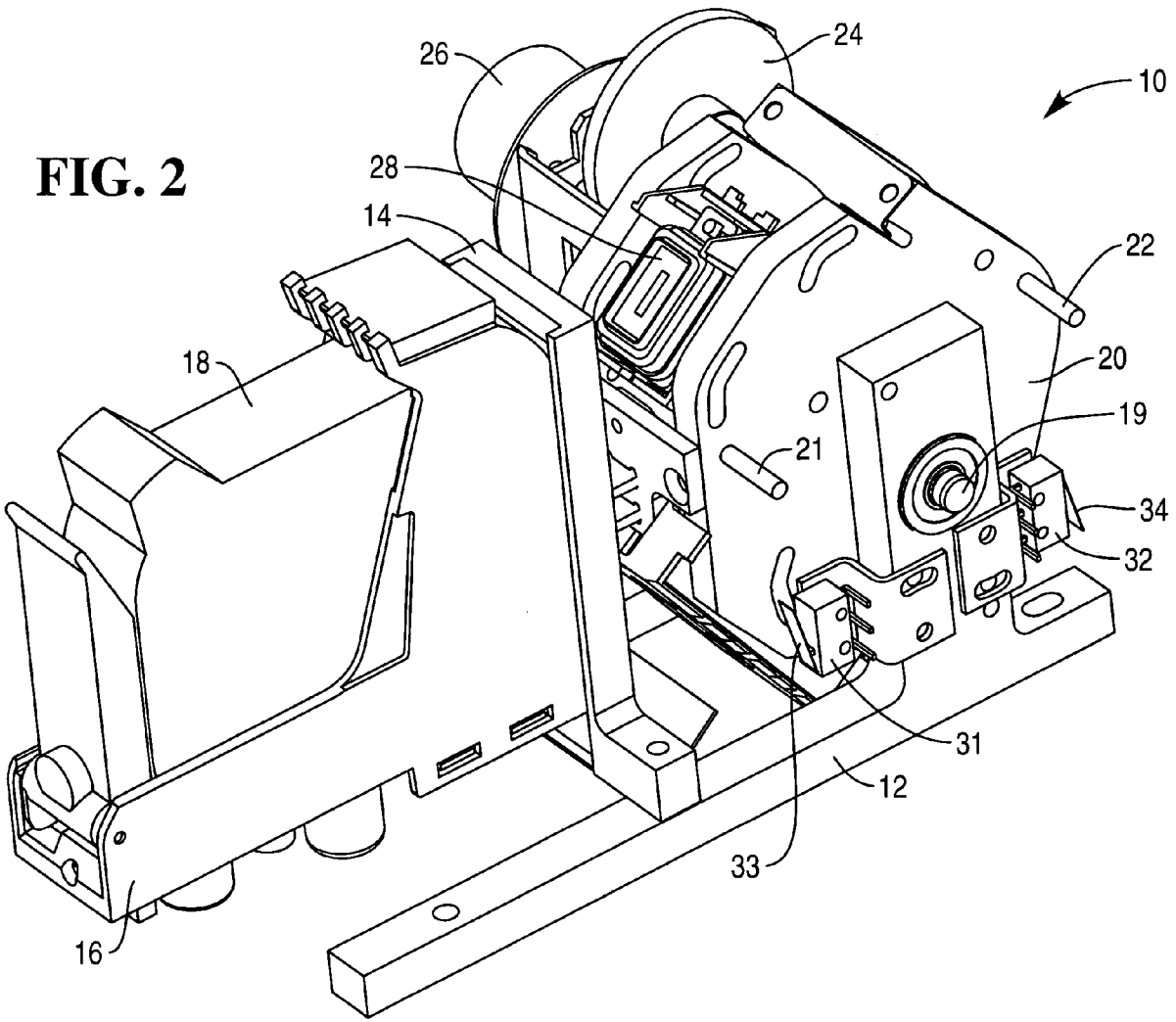
FIG. 2 is a perspective view similar to FIG. 1, and showing the inkjet head between the capped position and a print position.
Figure 3:
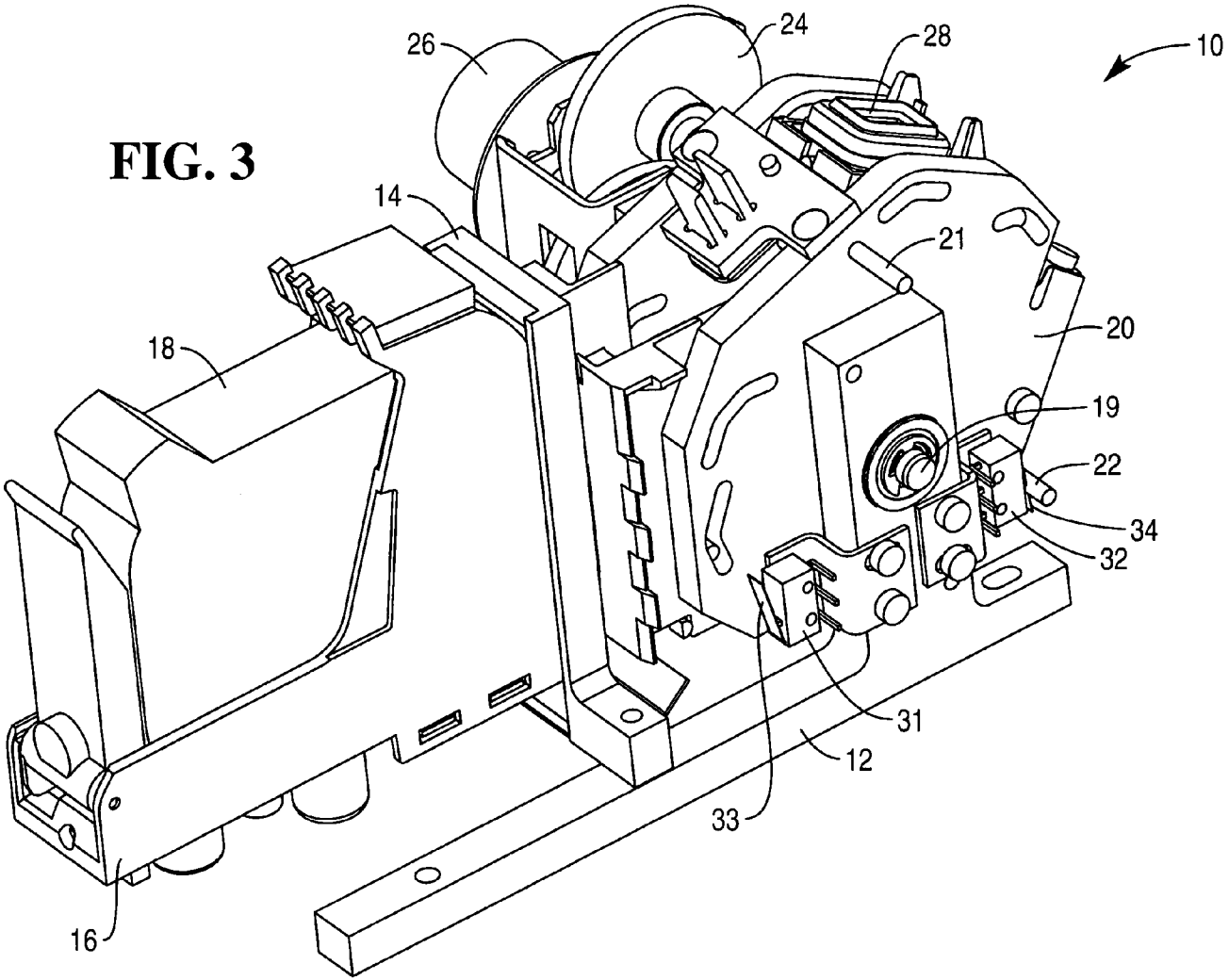
FIG. 3 is a perspective view similar to FIG. 2, and showing the inkjet head in the print position.

The capping assembly 20 moves with the shaft 19 from a capped position shown in FIG. 1 through an intermediate position shown in FIG. 2 to a print position shown in FIG. 3 when the motor 26 is actuated to rotate its output shaft in one direction. The capping assembly 20 moves with the shaft 19 from the print position shown in FIG. 3 through the intermediate position shown in FIG. 2 back to the capped position shown in FIG. 1 when the motor 26 is actuated to rotate its output shaft in the opposite direction.

The capping assembly 20 includes a cap portion 28, as best shown in FIG. 2. When parts are in the capped position as shown in FIG. 1, the cap portion 28 engages the area of the inkjet heads of the cartridge 18 in a known manner to prevent the inkjet heads from drying up. When parts are in the print position as shown in FIG. 3, the cap portion 28 is moved away from the area of the inkjet heads so as to allow the inkjet heads to print on a media item, such as a check item being processed at an automated teller machine.

An activatable first switch 31 having an arm member 33 is securely connected to the first frame part 12. A first pin 21 is attached to a position on the capping assembly 20 such that the first switch 31 is activated when the capping assembly moves to the capped position as shown in FIG. 1. Similarly, an activatable second switch 32 having an arm member 34 is securely connected to the first frame part 12. A second pin 22 is attached to a position on the capping assembly 20 such that the second switch 32 is activated when the capping assembly moves to the print position as shown in FIG. 3. The first switch 31 is inactivated when the second switch 32 is activated, as shown in FIG. 3. The second switch 32 is inactivated when the first switch 31 is activated, as shown in FIG. 1.

Figure 4:
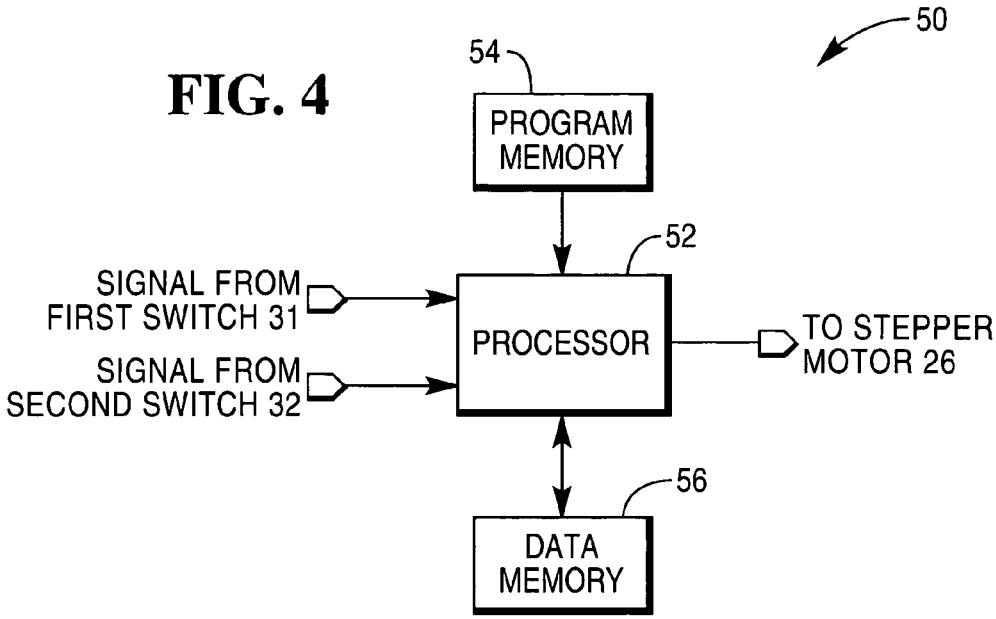
FIG. 4 is a block diagram representation of an inkjet controller in accordance with the present invention.

Referring to FIG. 4, an inkjet controller 50 includes a processor 52 which communicates with a program memory 54 and a data memory 56. The program memory 54 stores programs executable by the processor. The stored programs include a number of executable programs in accordance with the present invention. The data memory 56 stores data collected during program execution and operation of the controller 52. The processor 52 monitors a number of inputs including a signal from the first switch 31 and a signal from the second switch to provide an output signal for controlling operation of the stepper motor 26. Although the program memory 54 and the data memory 56 are shown separate in FIG. 4, it is conceivable the memories may comprise a single memory.

Figure 5:
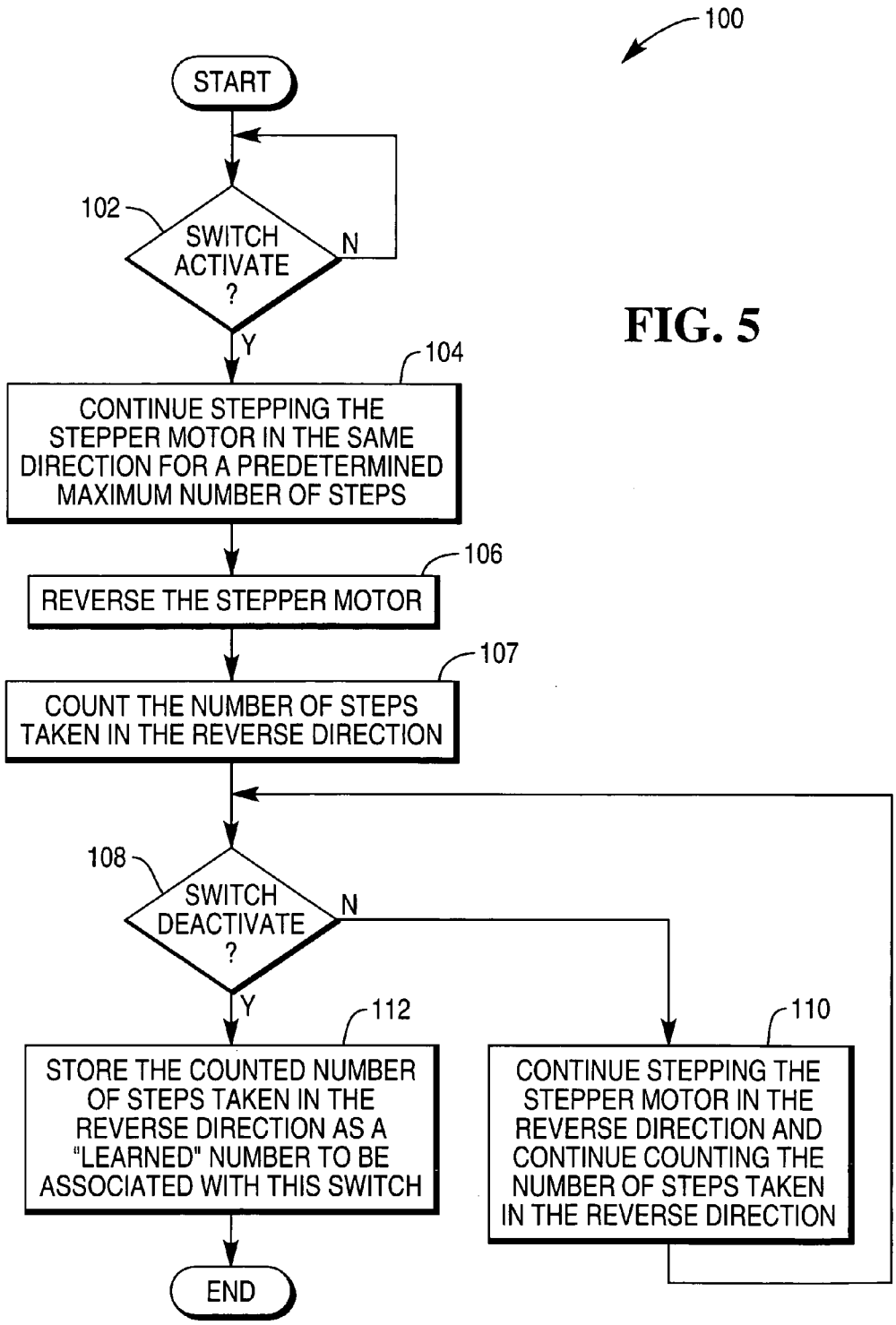
FIG. 5 is a flowchart depicting steps of a program in accordance with the present invention.

Referring to FIG. 5, a flowchart 100 depicts steps of a program in which a "learned" distance is determined and associated with each of the first and second switches 31, 32. It is contemplated that the program executes each time power is turned on. The "learning" process is the same for each switch. For simplicity, only the learning process and the learned distance associated with the first switch 31 will be described in detail herein.

In step 102, the first switch 31 is monitored for activation thereof. The first switch 31 activates and provides an activation signal indicative thereof when the output shaft of the motor 26 turns in a direction to move the capping assembly 20 toward the capped position shown in FIG. 1 and the first pin 21 engages the arm member 33 of the first switch. Upon the first switch 31 activating, the program proceeds to step 104 in which the motor 26 is controlled to continue turning its output shaft in the same direction for a predetermined maximum number of stepper motor steps. This predetermined maximum number of stepper motor steps may be stored in the data memory 56, for example.

After the output shaft of the motor 26 turns in the same direction for the predetermined maximum number of stepper motor steps, the motor is then controlled so as to reverse the direction of rotation of the output shaft as shown in step 106. This results in reverse direction of movement of the capping assembly 20. As shown in step 107, the number of stepper motor steps taken by the motor 26 in the reverse direction is counted as the motor operates to move the capping assembly 20 in the reverse direction which is away from the capped position.

The capping assembly 20 continues to move in the reversed direction away from the capped position until the first switch 31 deactivates as a result of the first pin 21 moving away from the arm member 33 of the first switch. The first switch 31 is monitored for deactivation thereof, as shown in step 108. The number of steps taken by the motor 26 in the reverse direction away from the capped position continues to be counted as the motor 26 continues to turn its output shaft in the reversed direction, as shown in step 110.

When the first switch 31 deactivates in step 108 as a result of reverse direction of movement of the capping assembly 20, the program proceeds to step 112. In step 112, the number of stepper motor steps taken by the motor 26 and counted in step 107 is stored in the data memory 56. This stored number is referred to herein as a first "learned" number which is associated with the first switch 31.

It is conceivable that some hysteresis may be associated with the first switch 31. To compensate for hysteresis, the motor 26 may be actuated to reverse itself again after the first switch 31 deactivates in step 108. The motor 26 moves the capping assembly 20 again towards the capped position until the first switch 31 activates. The number of stepper motor steps taken by the motor 26 from the time it deactivated in step 108 until the time the first switch activates again is counted. This number of stepper motor steps counted for switch activation is subtracted from the number of stepper motor steps counted for switch deactivation to provide a modified count which is stored as the first learned number associated with the first switch 31.

Similarly, a second "learned" number is associated with the second switch 32. The second learned number is generated in the same manner as described hereinabove for the first switch 31, except that the capping assembly 20 is moving toward the print position as shown in FIG. 3 instead of the capped position as shown in FIG. 1. The second learned number is also stored in the data memory 56. The second learned number may also be compensated for hysteresis which may be associated with the second switch 32. It is conceivable the second learned number may be substantially the same as the first learned number.

Figure 6:
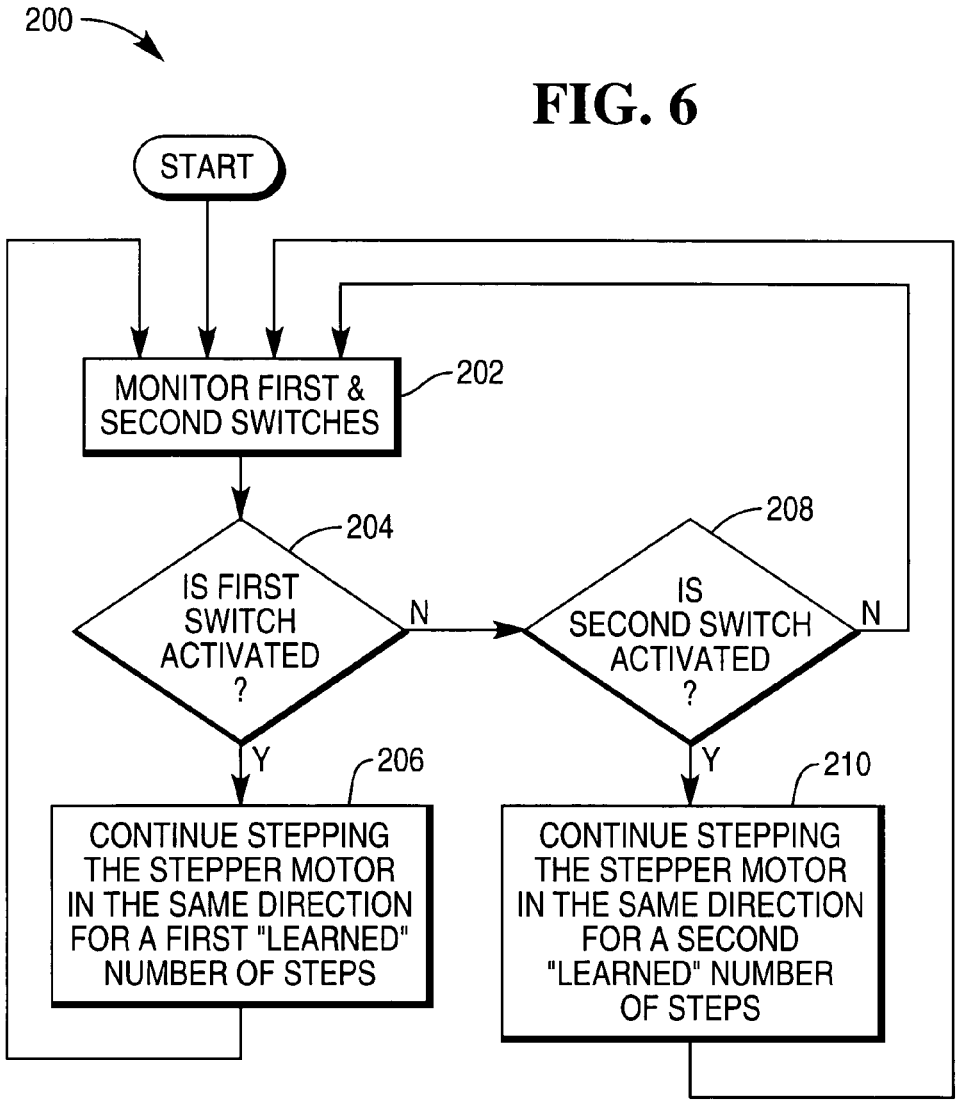
FIG. 6 is a flowchart depicting steps of another program in accordance with the present invention.

Referring to FIG. 6, a flowchart 200 depicts steps of a program which controls positioning of the capping assembly 20 based upon the first learned number and the second learned number generated from the learning process of FIG. 5. As shown in step 202, each of the first and second switches 31, 32 is monitored for activation thereof. If a determination is made in step 204 that the first switch 31 has activated (i.e., the first switch has activated in response to the capping assembly 20 moving towards the capped position shown in FIG. 1), the program proceeds to step 206. In step 206, the motor 26 remains actuated to continue rotating its output shaft in the same direction toward the capped position of FIG. 1 based upon the first learned number which has been stored in the data memory 56 as described above.

However, if the determination in step 204 is negative, the program proceeds to step 208 to determine if the second switch 32 has activated (i.e., the second switch has activated in response to the capping assembly 20 moving towards the print position shown in FIG. 3). When the determination in step 208 is affirmative, the program proceeds to step 210. In step 210, the motor 26 remains actuated to continue rotating its output shaft in the same direction toward the print position of FIG. 3 based upon the second learned number which has been stored in the data memory 56 as described hereinabove.

Figure 7:
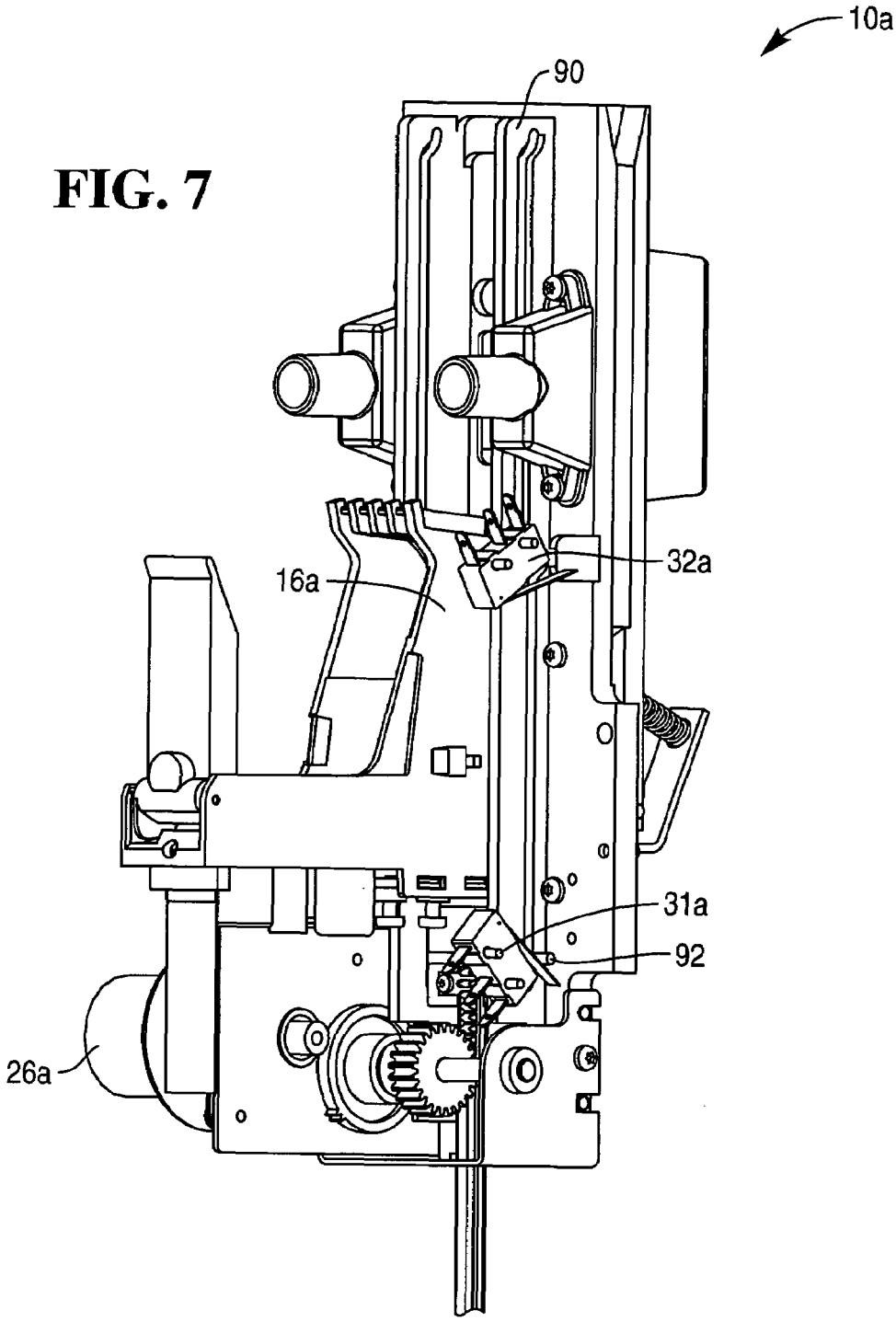
FIG. 7 is a perspective view of a linear-type of inkjet mechanism embodying the present invention, and showing an inkjet head in a capped position.
Figure 8:
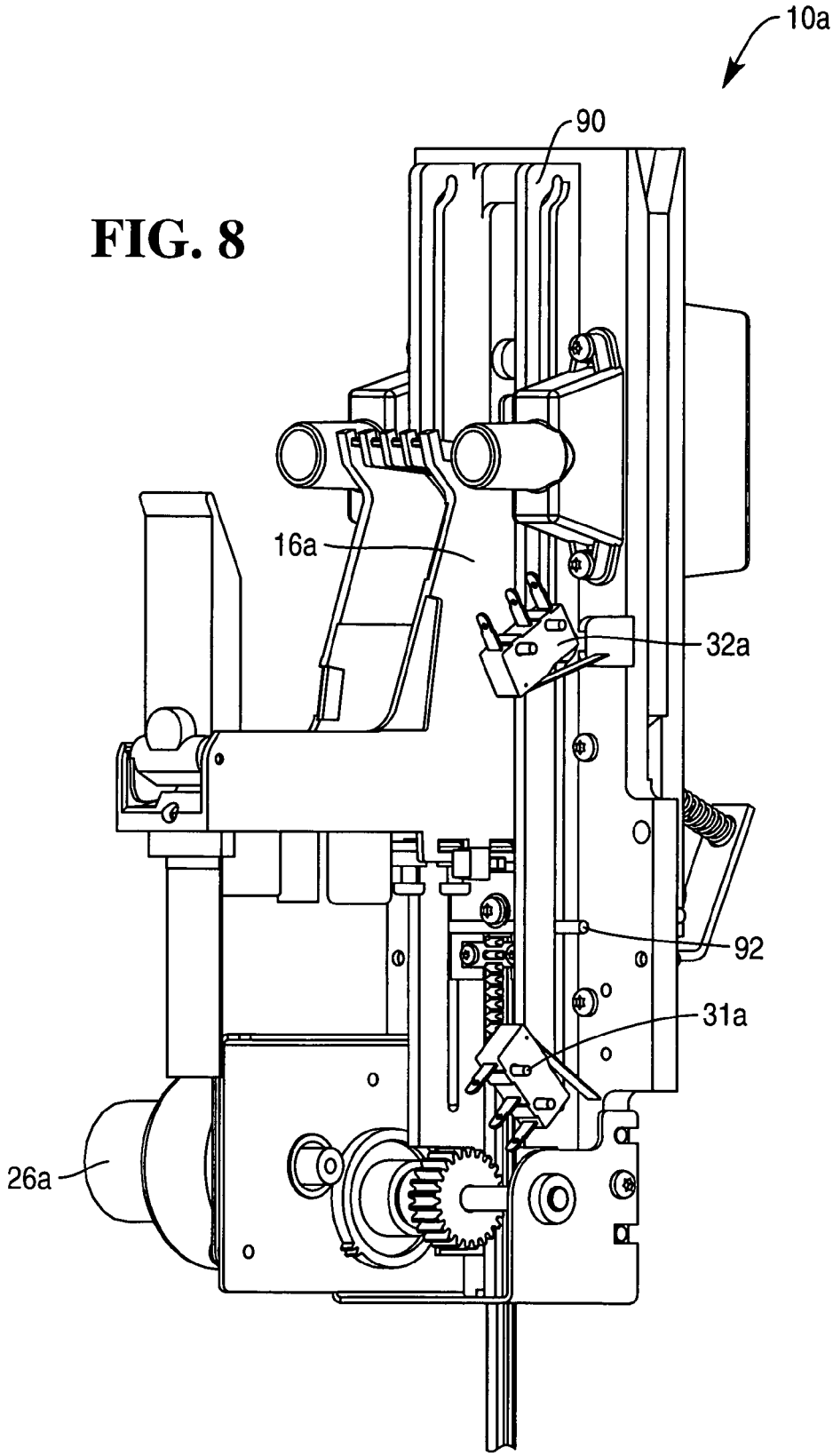
FIG. 8 is a perspective view similar to FIG. 7, and showing the inkjet head between the capped position and a print position.
Figure 9:
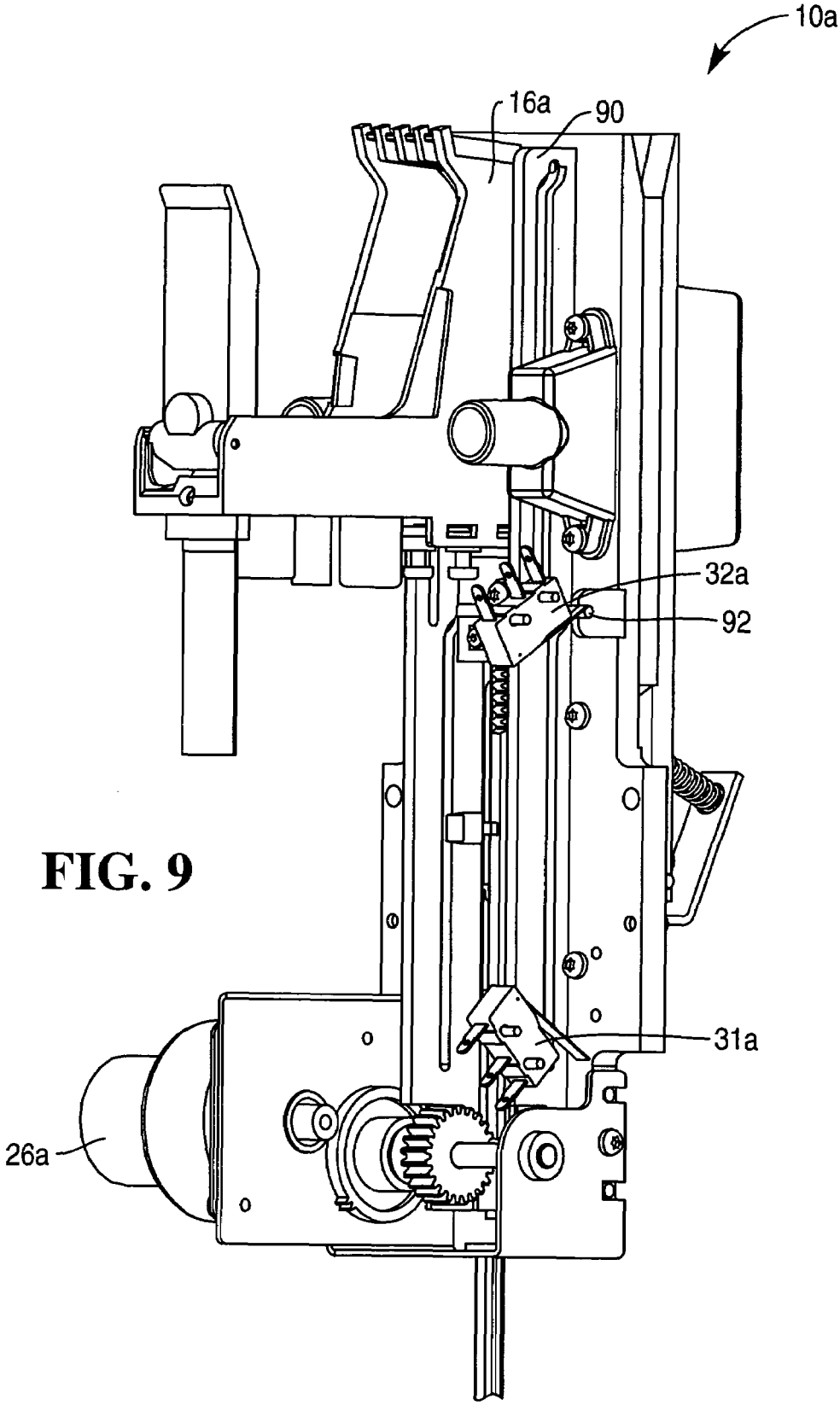
FIG. 9 is a perspective view similar to FIG. 8, and showing the inkjet head in the print position.

Although the above description describes an inkjet mechanism of a rotary-type, as illustrated in FIGS. 1-3, it is contemplated that the inkjet mechanism may of a linear-type, such as illustrated in FIGS. 7-9. Since the embodiment of the present invention illustrated in FIGS. 7-9 is generally similar to the embodiment illustrated in FIGS. 1-3, similar numerals are utilized to designate similar components, the suffix letter "a" being associated with embodiment of FIGS. 7-9 to avoid confusion.

Referring to FIG. 7, the linear-type of inkjet mechanism 10*a* may be used in item processing applications such as check processing transports. The cartridge holding bracket 16*a* is slidable along a guide member 90 in known manner. So that certain parts can be more clearly viewed, no inkjet cartridge is shown in the bracket 16*a* in FIG. 7. The capping assembly (not shown) is linearly movable along the guide member 90. The capping assembly moves along the guide member 90 from the capped position shown in FIG. 7 through the intermediate position shown in FIG. 8 to the print position shown in FIG. 9 when the motor 26*a* is actuated to rotate its shaft in one direction. The capping assembly moves along the guide member 90 from the print position shown in FIG. 9 through the intermediate position shown in FIG. 8 back to the capped position shown in FIG. 7 when the motor 26*a* is actuated to rotate its shaft in the opposite direction.

A single pin 92 is attached to a position on the capping assembly such that the first switch 31*a* is activated when the capping assembly is in the capped position as shown in FIG. 7. The second switch 32*a* is activated when the capping assembly is moved to the print position shown in FIG. 9. The first switch 31*a* is inactivated when the second switch 32*a* is activated, as shown in FIG. 9. The second switch 32*a* is inactivated when the first switch 31*a* is activated, as shown in FIG. 7.

The learning process for each of the first and second switches 31*a*, 32*a* in the embodiment of FIGS. 7-9 is the same as that described hereinabove for the embodiment of FIGS. 1-3. Also, the positioning of the capping assembly in the embodiment of FIGS. 7-9 is the same as that described hereinabove for the embodiment of FIGS. 1-3.

When a switch arrangement is employed to provide positional information about the inkjet head, it should be apparent that the final stopping position of the inkjet head relative to the activation point of the switch will vary. The extent of this variability will depend upon how the switch is mounted during assembly and the switching point tolerances of the particular switch used. A switch with tight switching point tolerances provides precise and consistent points at which the switch activates and deactivates. However, as previously mentioned, a switch with tight switching point tolerances is a relatively costly device. Accordingly, it should be apparent that each of the inkjet mechanisms 10, 10*a* described hereinabove needs to use only low cost switches since there is no need for tight switching point tolerances of switches to provide relatively precise and accurate positional information about the inkjet head. Variations resulting from the use of low cost switches and/or the way in which the switches are mounted during assembly are compensated for while the learning process is performed as described hereinabove for the switches.

It should also be apparent that no manual adjustment is required of switches in each of the inkjet mechanisms 10, 10*a* described hereinabove. This is because any adjustment which may be needed is accommodated for during the learning of the switches. Further, it should be apparent that if the activation point of any switch changes due to aging of the switch during operation thereof, this will be automatically compensated for each time power is turned on.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. An inkjet apparatus comprising:

an inkjet head assembly and a capping assembly movable relative to each other between a first position in which the inkjet head assembly is capped and a second position in which the capping assembly is clear of the inkjet head assembly;

an activatable first switch for, when activated, providing a first signal indicative of the inkjet head assembly and the capping assembly approaching one of the first and second positions;

an actuatable stepper motor for (i) moving the inkjet head assembly and the capping assembly toward the first position when the stepper motor is actuated to operate in a first direction, and (ii) moving the inkjet head assembly and the capping assembly toward the second position when the stepper motor is actuated to operate in a second direction which is opposite the first direction; and a controller for (i) detecting presence of the first signal from the first switch, and (ii) controlling the stepper motor such that the inkjet head assembly and the capping assembly continue to move relative to each other a first previously learned distance towards the one of the first and second positions upon the first signal from the first switch being detected.

2. An inkjet apparatus according to claim 1, further comprising:

an activatable second switch for, when activated, providing a second signal indicative of the inkjet head assembly and the capping assembly approaching the other one of the first and second positions.

3. An inkjet apparatus according to claim 2, wherein the controller detects presence of the second signal from the second switch, and controls the stepper motor such that the inkjet head assembly and the capping assembly continue to move relative to each other a second previously learned distance towards the other one of the first and second positions of the inkjet head upon the second signal from the second switch being detected.

4. An inkjet apparatus according to claim 3, wherein the second previously learned distance and the first previously learned distance are substantially the same.

5. A method of generating learned distances for later use in accurately positioning an inkjet head assembly and a capping assembly relative to each other between a print position and a capped position, the learned distances being generated each time power is turned on for operation of the inkjet assembly and the capping assembly, the method comprising the steps of:

moving one of the assemblies in a first direction towards the print position until a first switch signal is provided;

continue moving the one of the assemblies in the first direction until the one of the assemblies is unable to move further in the first direction;

moving the one of the assemblies in a second direction which is opposite the first direction after the one of the assemblies is unable to move further in the first direction;

continue moving the one of the assemblies in the second direction until a second switch signal is provided;

tracking a first distance taken from when the one of the assemblies is unable to move further in the first direction until the second switch signal is provided; and storing the tracked first distance as a first learned distance for later use in accurately positioning the inkjet head assembly and the capping assembly relative to each other in the print position.

6. A method according to claim 5, further comprising:

moving the one of the assemblies in the second direction towards the capped position until a third switch signal is provided;

continue moving the one of the assemblies in the second direction until the one of the assemblies is unable to move further in the second direction;

moving the one of the assemblies in the first direction which is opposite the second direction after the one of the assemblies is unable to move further in the second direction;

continue moving the one of the assemblies in the first direction until a fourth switch signal is provided;

tracking a second distance taken from when the one of the assemblies is unable to move further in the second direction until the fourth switch signal is provided; and storing the tracked second distance as a second learned distance for later use in accurately positioning the inkjet head assembly and the capping assembly relative to each other in the capped position.

7. A method according to claim 6, wherein the first and second learned distances are substantially the same.

8. A method of generating learned distances for later use in accurately positioning an inkjet head assembly and a capping assembly relative to each other between a print position and a capped position, the learned distances being generated each time power is turned on for operation of the inkjet assembly and the capping assembly, the method comprising the steps of:

moving one of the assemblies in a first direction towards the capped position until a first switch signal is provided;

continue moving the one of the assemblies in the first direction until the one of the assemblies is unable to move further in the first direction;

moving the one of the assemblies in a second direction which is opposite the first direction after the one of the assemblies is unable to move further in the first direction;

continue moving the one of the assemblies in the second direction until a second switch signal is provided;

tracking a first distance taken from when the one of the assemblies is unable to move further in the first direction until the second switch signal is provided; and storing the tracked first distance as a first learned distance for later use in accurately positioning the inkjet head assembly and the capping assembly relative to each other in the capped position.

* * * * *